US011210888B1

(12) United States Patent
Moore

(10) Patent No.: US 11,210,888 B1
(45) **Date of Patent: *Dec. 28, 2021**

(54) CASH COUNTER RECYCLING APPARATUS AND METHODS

(71) Applicant: Wells Fargo Bank, N.A., San Francisco, CA (US)

(72) Inventor: Alicia Moore, San Ramon, CA (US)

(73) Assignee: Wells Fargo Bank, N.A., San Francisco, CA (US)

( * ) Notice: Subject to any disclaimer, the term of this patent is extended or adjusted under 35 U.S.C. 154(b) by 12 days.

This patent is subject to a terminal disclaimer.

(21) Appl. No.: 16/673,527

(22) Filed: Nov. 4, 2019

Related U.S. Application Data

(63) Continuation of application No. 14/569,187, filed on Dec. 12, 2014, now Pat. No. 10,467,843.

(60) Provisional application No. 62/033,910, filed on Aug. 6, 2014.

(51) Int. Cl.

| | |
|---|---|
| ***G07D 11/50*** | (2019.01) |
| ***G07D 11/34*** | (2019.01) |
| ***G07D 11/16*** | (2019.01) |
| ***G07D 11/14*** | (2019.01) |
| ***G07D 11/235*** | (2019.01) |
| ***G07D 11/26*** | (2019.01) |

(52) U.S. Cl.
CPC ..... *G07D 11/50* (2019.01); *G07D 11/14* (2019.01); *G07D 11/16* (2019.01); *G07D 11/235* (2019.01); *G07D 11/26* (2019.01); *G07D 11/34* (2019.01)

(58) Field of Classification Search
CPC ..... G07D 11/50; G07D 11/16; G07D 11/14; G07D 11/34; G07D 11/235; G07D 11/26; G07F 9/10; G07F 9/105
USPC ..... 194/206, 207, 351, 352; 209/534; 235/379
See application file for complete search history.

(56) References Cited

U.S. PATENT DOCUMENTS

| | | | | |
|---|---|---|---|---|
| 4,453,667 | A | 6/1984 | Zerfahs | |
| 4,977,502 | A | 12/1990 | Baker et al. | |
| 5,626,822 | A * | 5/1997 | Kadowaki | A61L 2/04 422/307 |
| 6,946,106 | B1 * | 9/2005 | Masyada | A61L 2/02 162/359.1 |
| 2004/0134839 | A1 | 7/2004 | Kobayashi et al. | |
| 2006/0060363 | A2 | 3/2006 | Carter | |
| 2009/0188974 | A1 * | 7/2009 | Haycock | G07D 11/36 235/379 |

(Continued)

*Primary Examiner* — Jeffrey A Shapiro
(74) *Attorney, Agent, or Firm* — Foley & Lardner LLP

(57) ABSTRACT

Apparatus and methods relating to a counter recycling device are described. The counter recycling device may contain a receiving pocket, a counter mechanism, an escrow section, and an escrow door. The receiving pocket is configured to accept currency and is connected to the counter mechanism. The counter mechanism may be configured to count the currency inserted into the receiving pocket. The counter recycling device may also include an escrow section, which may be configured to collect and hold the currency in a secure area. Additionally, the counter recycling device may include an escrow door configured to enclose the escrow section on a face of the counter recycling device, the escrow door being transparent and allowing currency within the escrow section to be viewable when the escrow door is in a closed position.

23 Claims, 6 Drawing Sheets

(56) References Cited

U.S. PATENT DOCUMENTS

| | | | | |
|---|---|---|---|---|
| 2009/0301679 | A1* | 12/2009 | Wetherell | B08B 3/022 162/359.1 |
| 2010/0230231 | A1* | 9/2010 | Uesaka | G07D 11/40 194/206 |
| 2010/0274382 | A1 | 10/2010 | Mizushima | |
| 2011/0229696 | A1* | 9/2011 | Ratnukumar | G07D 7/187 428/172 |
| 2012/0173013 | A1 | 7/2012 | Nakamoto et al. | |
| 2012/0192771 | A1 | 8/2012 | Guan et al. | |
| 2013/0045133 | A1* | 2/2013 | Maguire | G07G 1/0018 422/24 |
| 2013/0264168 | A1 | 10/2013 | Usem | |
| 2014/0116474 | A1* | 5/2014 | Lawandy | G07D 11/50 134/34 |
| 2015/0170452 | A1 | 6/2015 | Chugo | |
| 2015/0314977 | A1* | 11/2015 | Takada | B65H 31/06 271/306 |
| 2017/0098134 | A1* | 4/2017 | Jones | G07D 11/50 |

* cited by examiner

CASH COUNTER RECYCLING APPARATUS AND METHODS

CROSS-REFERENCE TO RELATED PATENT APPLICATIONS

This application is a continuation of U.S. patent application Ser. No. 14/569,187 filed Dec. 12, 2014 which claims priority to U.S. Provisional Application No. 62/033,910, titled "Cash Counter Recycling Apparatus and Methods" filed Aug. 6, 2014, incorporated herein by reference in their entireties.

BACKGROUND

The present disclosure relates generally to devices configured to accept paper currency.

A large number of financial transactions are processed daily at financial institutions around the world. As such, a bank teller's operational flow often plays an important role in the success of the financial institutions and satisfaction of customers. Generally, during financial transactions with a customer at a financial institution, a bank teller processes deposits, for example, by receiving the currency from the customer and counting the currency. In some instances, the customer may count the currency in front of the bank teller and then hand the currency to the bank teller to be recounted before the transaction is processed. After the currency is counted by the bank teller, the bank teller must then open compartments or drawers of a teller bus to deposit the currency. Some devices currently available to aid the work flow of a bank teller may be used to count currency. The bank teller then removes the currency from the counter to deposit in the teller bus.

SUMMARY

One embodiment of the disclosure describes a counter recycling device. The counter recycling device may contain a receiving pocket configured to accept currency and a counter mechanism connected to the receiving pocket to receive the currency. The counter mechanism may be configured to count the currency inserted into the receiving pocket. The counter recycling device may also include an escrow section, which may be configured to collect and hold the currency in a secure area. Additionally, the counter recycling device may include an escrow door configured to enclose the escrow section on a face of the counter recycling device, the escrow door allowing content within the escrow section to be viewable.

Another embodiment of the disclosure relates to a method for counting and recycling currency. The method may comprise accepting currency into a receiving pocket on an exterior of a counter recycling device. The method may further comprise transferring the currency to a currency counter in the counter recycling device and counting the currency input into the receiving pocket using the currency counter. Additionally, the method may comprise receiving the currency as counted into an escrow section positioned within the counter recycling device, the escrow section being configured to allow the currency to be viewable through an escrow door in a closed position. In some embodiments, the method includes receiving an initiation to transfer the currency from the escrow section to a deposit area within the counter recycling device and determining that the escrow door remained in the closed position since the time the currency as counted entered the escrow section.

The method may also include transferring the currency from the escrow section to a deposit area in the counter recycling device.

BRIEF DESCRIPTION OF THE DRAWINGS

The details of one or more implementations of the subject matter described in this specification are set forth in the accompanying drawings and the description below. Other features, aspects, and advantages of the subject matter will become apparent from the description, the drawings, and the claims.

DETAILED DESCRIPTION OF EXAMPLE EMBODIMENTS

The apparatus and methods described below relate to a counter recycling device 100. The counter recycling device 100 includes a receiving pocket to receive currency, a counter mechanism to count the currency received by the device, and an escrow section to safe keep the currency. An escrow door encloses the escrow section to maintain the integrity of the counted amount. Providing an additional layer of security, the escrow door may be transparent such that the counted currency may be viewed in the escrow section. According to some embodiments, the escrow door may provide an alert or indication if the door is opened or touched. The amount of currency deposited into the escrow section may be confirmed, and the currency may be deposited within a deposit area of the counter recycling device without requiring a user to remove the currency from the escrow section. The device may be configured to perform counting and recycling services. The term "recycling" as used herein refers to receiving paper currency in a first transaction and later dispensing the previously received currency in a second transaction. In other cases, instead of recycling the received currency, the counter recycling device may receive, deposit, and hold the currency in a first various areas as described throughout.

Figure 1:
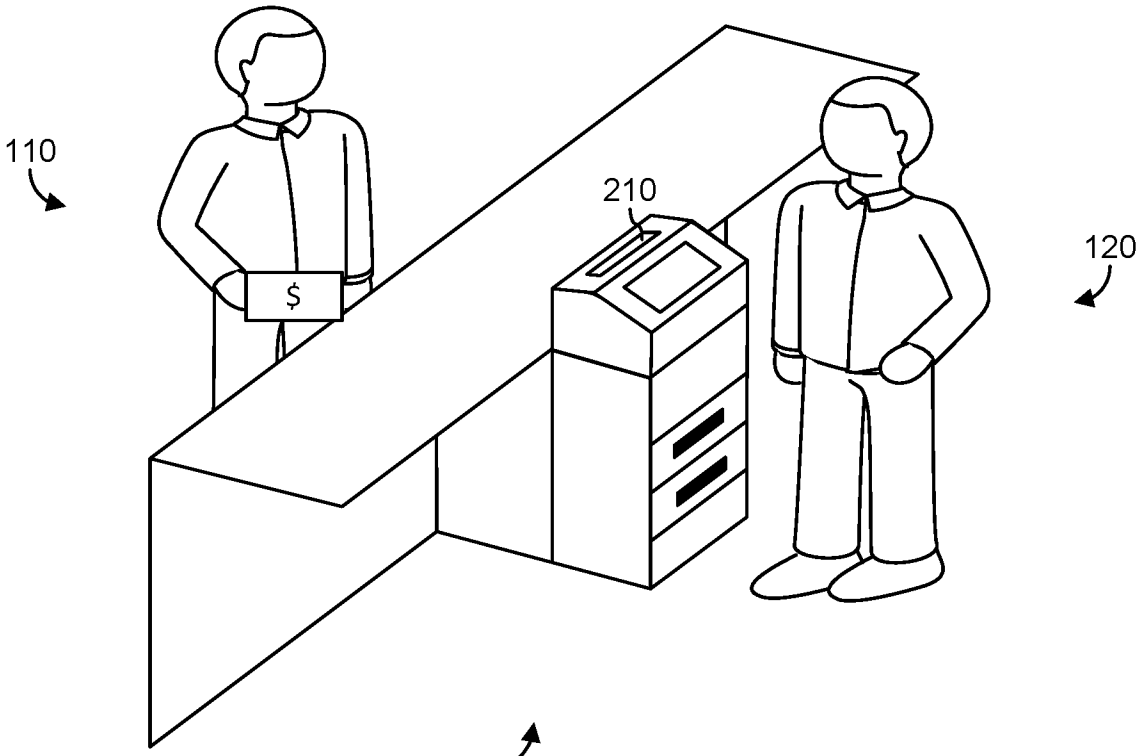
FIG. 1 is a perspective view of a counter recycling device in the environment of a financial institution according to an example embodiment.

Referring to FIG. 1, a perspective view of a counter recycling device 100 in the environment of a financial institution according to an example embodiment is shown. The counter recycling device 100 may be used at a financial institution such as a bank and operated by a user (i.e., a teller). In FIG. 1, a customer 110 and operator 120 (i.e., a bank teller, branch manager, or any employee) of a financial institution is shown engaging in a financial transaction. For example, the customer 110 is shown depositing currency into a financial account. The operator 120 may retrieve the currency from the customer 110 and deposit the currency into the counter recycling device 100. According to some embodiments, the counter recycling device 100 may facilitate a convenient work flow process that fosters confidence with the customer 110 depositing the currency by decreasing human interaction with the currency following an agreeable count. The counter recycling device 100 may also decrease the amount of time spent by an operator 120 in processing a transaction, thus resulting in increased productivity. In some embodiments, the counter recycling device 100 may replace the traditional teller bus or currency holding device at financial institutions. In other embodiments, the counter recycling device 100 may be implemented in a variety of systems configured to receive and/or receive and output currency. For example, the counter recycling device 100 may be part of an automated teller machine, a bank teller bill recycler, a vending machine, etc. In some embodiments, the counter recycling device 100 may include a back portion extending away from the face of the counter recycling device 100. In some embodiments, the back portion is shorter in height than the front section of the counter recycling device 100. The shorter height may accommodate a variety of placement positions of the counter recycling device 100 in the financial institution. For example, the back portion may be configured to fit under a counter at a teller station in a financial institution, as shown in FIG. 1.

Figure 2:
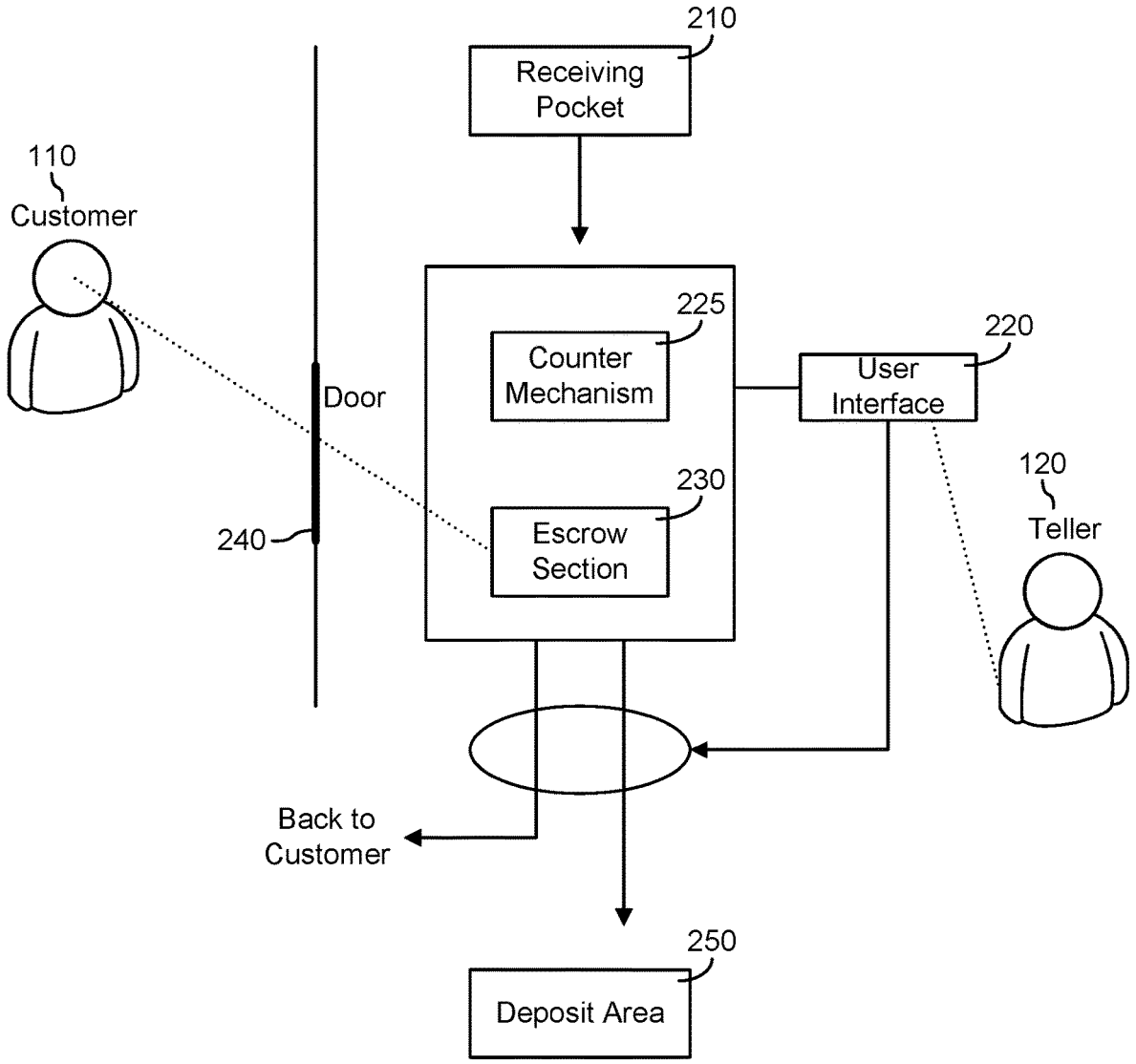
FIG. 2 is a schematic diagram of currency flow through the counter recycling device of FIG. 1 according to an example embodiment.

FIG. 2 is a schematic diagram of currency flow through the counter recycling device of FIG. 1 according to an example embodiment. The counter recycling device 100 may contain a receiving pocket 210, a user interface 220 (e.g., display), a counter mechanism 225, an escrow section 230, an escrow door 240, and a deposit area 250. The receiving pocket 210 is a section on the counter recycling device 100 that is configured to accept currency. In some embodiments, the receiving pocket 210 may be configured to accept paper currency. In other embodiments, the receiving pocket 210 may accept both paper currency and coins. In FIG. 2, the receiving pocket 210 is positioned near a top portion of the counter recycling device 100 upstream the user interface 220. However, it should be understood that the receiving pocket 210 may be located at any place on the body of the counter recycling device 100.

The user interface 220 may comprise a mechanism or module for communicating with the counter recycling device 100. The user interface 220 may allow an operator 120 to input and receive information through a variety of mechanisms, including but not limited to, a display, a touch-screen display, a touch pad, keyboard, smart pad, keypad, a button, a release mechanism, a controller device, etc. The counter recycling device 100 may contain a plurality of user interface mechanisms in different positions on a body of the counter recycling device 100. In one arrangement, a display may be positioned on a top face of the counter recycling device 100. In another arrangement, a button may also be positioned on the counter recycling device 100 such that the button may be engaged to initiate an action (e.g., in-taking currency into the deposit area 250 from the escrow section 230).

The counter recycling device 100 may also include a counter mechanism 225 positioned within the body of the counter recycling device 100. The counter mechanism 225 receives the currency input into the receiving pocket 210 and counts the currency. A variety of sensors and other components used within a counting mechanism may be located and used in the counter recycling device 100 to accurately count the currency. In one embodiment, the counter mechanism 225 is positioned downstream of the receiving pocket 210 and behind a front panel of the counter recycling device 100. In other embodiments, the counter mechanism 225 may be positioned at any location within the body of the counter recycling device 100.

The escrow section 230 is a portion of the counter recycling device 100 that securely receives and holds the currency. In some arrangements, the escrow section 230 has an escrow door 240 that encloses the escrow section 230. The escrow door 240 may attach to the front of the escrow section 230. In some embodiments, the escrow door 240 provides the sole means available to an operator 120 for retrieving currency deposited into the escrow section 230. In other embodiments, the currency may be transferred to other portions of the counter recycling device 100 to be retrieved. The escrow door 240 may be made of a transparent material (e.g., transparent glass or plastic) such that the currency may be visible inside the escrow section 230 when the escrow door 240 is closed. In some embodiments, the contents of the escrow section 230 are visible to the customer 110 through the escrow door 240. In other embodiments, the contents of the escrow section 230 is visible to the operator 120 (i.e., teller). In yet another embodiment, the contents of the escrow section 230 may be visible to both the operator 120 and the customer 110 by way of the escrow door 240, a transparent window communicable with the escrow section, additional viewing mechanisms (e.g., a video camera), etc. In some embodiments, the escrow door 240 is sufficiently transparent such that currency inside the escrow section 240 may at least partially be viewable.

The escrow door 240 may be connected at a top wall of the escrow section 230. However, it is understood that the escrow door 240 may attach to the escrow section 230 in any manner and at any position on the counter recycling device 100. In some embodiments, the escrow door 240 may slide into a wall of the escrow section 230 as the escrow door 240 opens. The escrow section 230 may hold counted currency in the escrow section 230 on a currency transit mechanism portion, which facilitates the movement of currency throughout the counter recycling device 100. In another embodiment, the escrow section 230 may hold the counted currency in escrow on a floor of the escrow section 230. In yet another embodiment, the escrow section 230 may hold the currency in escrow on a tray 235 connectedly attached to a surface of the escrow section 230, further described below. As discussed above, the escrow door 240 may be transparent such that the contents of the escrow section 230 (i.e., currency) may be visible to an operator 120 and/or a customer 110.

In one embodiment, the currency within the escrow section 230 may be made visible by way of a viewing mechanism such as a camera. The position of the viewing mechanism inside the escrow section 230 may vary. The camera may be a video camera configured to capture images within the escrow section 230, and the images may be transferred to a display viewable to the customer 110 and/or the operator. For example, a display configured to show the images of the currency of an escrow section 230 may be located in a position where the display may be viewed by a customer 110. In one embodiment, the display may be imbedded within the counter or a wall of a teller station for viewing by the customer 110. In an alternate arrangement, the display may be placed on top of a counter space at a teller station. It is understood that the viewing mechanism may be placed outside the escrow section 230. Additionally, a plurality of viewing mechanisms may be employed to facilitate viewing of currency in the escrow section 230.

Along with a receiving pocket 210, a counter mechanism 225, a user interface 220, and an escrow section 230 with an escrow door 240, the counter recycling device 100 may also have a deposit area 250. The deposit area 250 may be configured to receive and hold currency taken into the receiving pocket 210. The operator 120 may engage the user interface 220 to allow the currency to be taken into the deposit area or retrieved out of the escrow section 230. In some embodiments, the user interface 220 may be used to send a withdrawal initiation for opening the escrow door 240 such that currency may be retrieved. In other embodiments, the user interface 220 may be used to send a transfer initiation for transferring the currency from the escrow section 230 to the deposit area 250. In one embodiment, the deposit area 250 comprises a plurality of drawers (i.e., 352, 354, and 356) for holding the currency. In another embodiment, the deposit area 250 may comprise a plurality of chambers, cassettes, or drums (i.e., 358) configured to receive currency directly from the escrow section 230. According to one embodiment, the deposit area 250 receives currency deposited into the escrow section 230 upon the conditions that 1) the escrow door 240 is in a closed position when the currency enters the escrow section 230 and that 2) the escrow door 240 remains closed throughout the transit of the currency from the escrow section 230 to the deposit area 250.

Figure 3A:
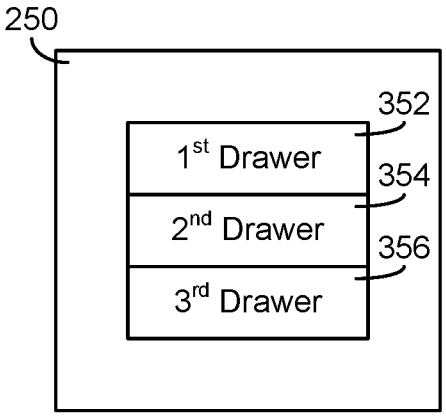
FIG. 3A is a schematic diagram of a configuration of the deposit area of the counter recycling device of FIG. 2 according to an example embodiment.

The deposit area 250 may have a variety of configurations, including the example embodiments shown in FIG. 3A-FIG. 3D. FIG. 3A is a schematic diagram of a configuration of the deposit area of the counter recycling device of FIG. 2 according to an example embodiment, where the deposit area 250 has a first drawer 352, a second drawer 354, and a third drawer 356. The first drawer 352 may contain a modest amount of working cash, for example, $1000. The second drawer 354 may be configured to hold coins, which may be bounded in coin wrappers. The third drawer 356 may be configured to hold a larger amount of cash, for example, $10,000. In some embodiments, the second drawer 354 is configured to hold the larger amount of cash and the third drawer 356 is configured to hold the coins. In some embodiments, the currency may be transferred to one of the first drawer 352, the second drawer 354, and the third drawer 356. In another embodiment, the currency may be transferred one or more of first drawer 352, second drawer 354, and third drawer 356. For example, if a customer 110 deposits $1000.00 in paper currency and $100 in coins, the $1000.00 in paper currency may be transferred to the third drawer 356 holding larger amounts of cash and the $100 in coins may be transferred to the second drawer 354 holding coins. In another example, a portion of either the $1000.00 in paper currency deposited or the $100.00 coins deposited may be transferred to the first drawer 352. In further embodiments, conditions such as the amount of currency in each drawer may determine where the input currency is deposited within the deposit area 250.

Figure 3B:
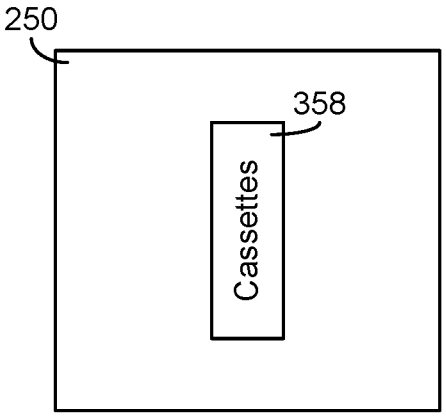
FIG. 3B is a schematic diagram of another configuration of the deposit area of the counter recycling device of FIG. 2 according to an example embodiment.
Figure 3C:
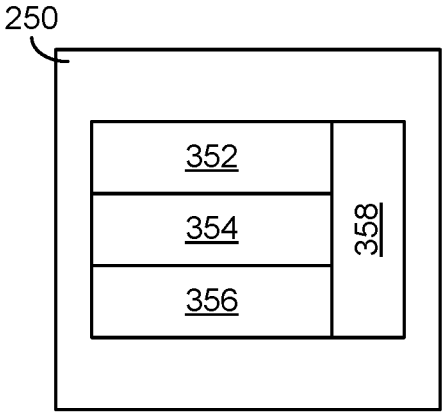
FIG. 3C is a schematic diagram of yet another configuration of the deposit area of the counter recycling device of FIG. 2 according to an example embodiment.
Figure 3D:
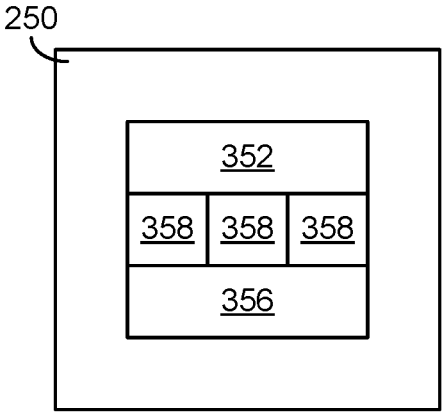
FIG. 3D is a schematic diagram of a further configuration of the deposit area of the counter recycling device of FIG. 2 according to an example embodiment.

FIG. 3B shows the deposit area 250 comprising one or more cassettes 358 or drums. FIG. 3C shows the deposit area 250 comprising a combination of drawers 352, 354, and 356 with cassettes 358 on a side of the drawers. In some embodiments, a cassette 358 may be placed on both sides of the drawers. FIG. 3D shows another example of the deposit area 250 having a plurality of cassettes 358 placed between the first drawer 352 and the bottom drawer 356. It is understood that in the configurations both shown and not shown, any plurality of drawers and cassettes or drum units may be used to collect and store the currency in the deposit area 250. Also, any configuration or arrangement of the drawers and cassettes may be accomplished.

A transit mechanism may be placed in the counter recycling device 100 in order to facilitate the transit of the currency between separate parts (i.e., the receiving pocket 210, the counter mechanism 225, the escrow section 230, and the deposit area 250) of the counter recycling device 100. The transit mechanism may comprise any device or system configured to transfer paper and/or coin currency throughout a device. The currency transit mechanism may include rollers, belts, and grippers configured to transport currency between the different parts of the counter recycling device 100. The currency transit mechanism is configured to transport received and accepted currency from the receiving pocket 210 to the escrow section 230 during deposit operations. The currency transit mechanism may also be configured to transport currency from the escrow section 230 to the deposit area 250. The currency transit mechanism may include a flipping mechanism such that received paper currency is stacked in the same direction within a given storage space. In some embodiments, a plurality of transit mechanisms may be used to transport currency between any parts of the counter recycling device 100.

In some embodiment, the currency may undergo a conditioning process at any point during a flow process. For example, the currency may pass one or more sensors configured to detect characteristics of the received currency. The sensors may be placed variously throughout the counter recycling device 100 and may provide feedback signals of the detected characteristics of the currency to a counter recycling computing system 500, which may communicate with a controller in the counter recycling device 100. According to one embodiment, the controller is configured to analyze the detected characteristics of the currency received from the sensors and validate the received currency as genuine based on the analysis. The detected characteristics may relate to a variety of properties of the received currency, including physical properties of the currency (e.g., size, weight, conductivity, fluorescent properties, reflective properties, security feature locations, magnetic properties, etc.) and optical properties of the currency (e.g., what is printed on the paper currency, the color of the currency, printed security feature attributes, pixel spacing, etc.). The controller may determine a denomination of the currency based on the above recited characteristics. Additionally, the controller may determine a condition of the currency based on the feedback signal relating to detected characteristics of the received paper currency from the sensor. In some embodiments, the currency input into the receiving pocket 210 may be rejected by the counter recycling device 100 if the currency is not genuine or if the condition of the currency falls outside of an acceptable range (e.g., the currency is mutilated).

In one embodiment, the transit mechanism may transport the received currency to several parts of the counter recycling device 100 on the conditions that the currency is deemed to be genuine and the condition of the currency is acceptable. The transport mechanism is coupled to at least one currency receiving component (e.g., the deposit area 250). In some embodiments, the currency transit mechanisms is coupled to the receiving pocket 210, the counter mechanism 225, the escrow section 230, and/or the deposit area 250. In one example, a plurality of currency transit mechanisms may work to transfer currency throughout the counter recycling device 100. In some arrangements, the deposit area 250, for example, may include one or more cassettes (e.g., one cassette for each denomination of accepted currency, a cassette for received currency that falls within the acceptable condition range but outside of a fit condition for recycling, a cassette that was preloaded with fit currency, etc.). Cassettes are configured to receive and store currency. If the counter recycling device 100 includes a plurality of cassettes, each of the plurality of cassettes may be designated to hold a particular denomination of currency. The cassettes may also be configured to dispense currency during withdrawal operations. At least one cassette of the plurality of cassettes may be configured to only store currency that is not fit for recycling. Each cassette may include a stacking mechanism configured to store currency in a stack structure.

According to some embodiments, the transit mechanism is coupled to a currency conditioner, which may selectively perform a conditioning operation discussed above on the paper currency while the currency is transported by the currency transit mechanism. The conditioning operation increases a fit level of the currency. By increasing the fit level of the currency, the currency may be transformed from currency that is not suitable for recycling (i.e., currency that is not capable of being dispensed) to currency that is suitable for recycling. The conditioning may be achieved at least in part by heating the received currency. Accordingly, the conditioner may include a heating element. In some arrangements, the heating element directly heats the received paper currency (i.e., as the received paper currency passes through the currency transit mechanism, the paper currency passes through the heating element). In other arrangements, the heating element heats components of the transit mechanism (e.g., a roller or a conveyor), which in turn heats the paper currency as it is routed through the currency transit mechanism. The components of the transit mechanism that are heated may be metal.

In some arrangements, the heating element includes a heat transfer system (e.g., a heat pipe, a heat exchanger, etc.) configured to transport heat from a heat-generating component within the counter recycling device 100, such as a controller or the user interface 220, to the received paper currency as described above. Heating the received paper currency may remove at least a portion of creases contained within the received paper currency thereby increasing the currency's suitability for recycling. In other arrangements, the currency transit mechanism may be configured to exert pressure on the inserted currency during the conditioning operation (e.g., by passing the received currency through opposing rollers or belts). The pressure may also assist in conditioning the inserted currency and increasing the currency's suitability for recycling. In additional arrangements, the conditioner may include a steaming device configured to steam the currency. As discussed further below, the counter recycling device 100 may be communicable with the counter recycling computing system 500 containing logic executable by a processor to implement the processes and functions described throughout the disclosure.

Figure 4:
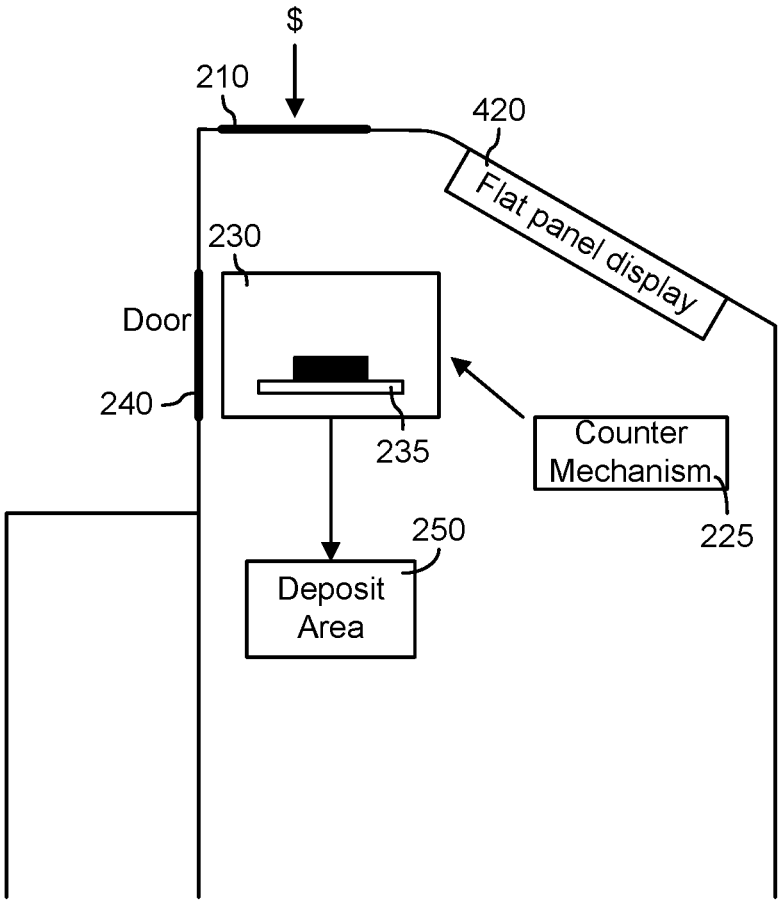
FIG. 4 is a schematic diagram of a side view of the counter recycling device according to an example embodiment.

FIG. 4 is a side view of a counter recycling device 100 according to an example embodiment. The counter recycling device 100 may have a flat panel display 420 as a user interface. Currency may be input into a receiving pocket 210 located on the top of the counter recycling device 100. The currency may be transferred to a counter mechanism 225 and then transferred to the escrow section 230. In some embodiments, the currency may be received into the escrow section 230 one bill and/or coin at a time. In another embodiment, the currency may be transferred into the escrow section 230 in a bundled arrangement. In some embodiments, the escrow section 230 may be placed near a back wall of the counter recycling device 100. An escrow door 240 may be connected to the escrow section 230 and sufficiently transparent such that a customer 110 may at least partially view currency inside the escrow section 230 through the escrow door 240 when the escrow door 240 is in a closed position. The escrow section 230 may have a tray 235 configured to at least partially extend outside the escrow door 240 when the escrow door 240 is open such that the currency may be retrieved. If a customer 110 chooses to deposit the currency, escrow door 240 may remain closed and the currency may be transferred to the deposit area 250. In some embodiments, the transit mechanism is configured to manipulate the position of the tray 235 to facilitate the transfer of the currency to the deposit area 250. For example, the tray 235 may slide onto different regions, partially open, retract, or cave in to facilitate the transfer, etc.

Figure 5:
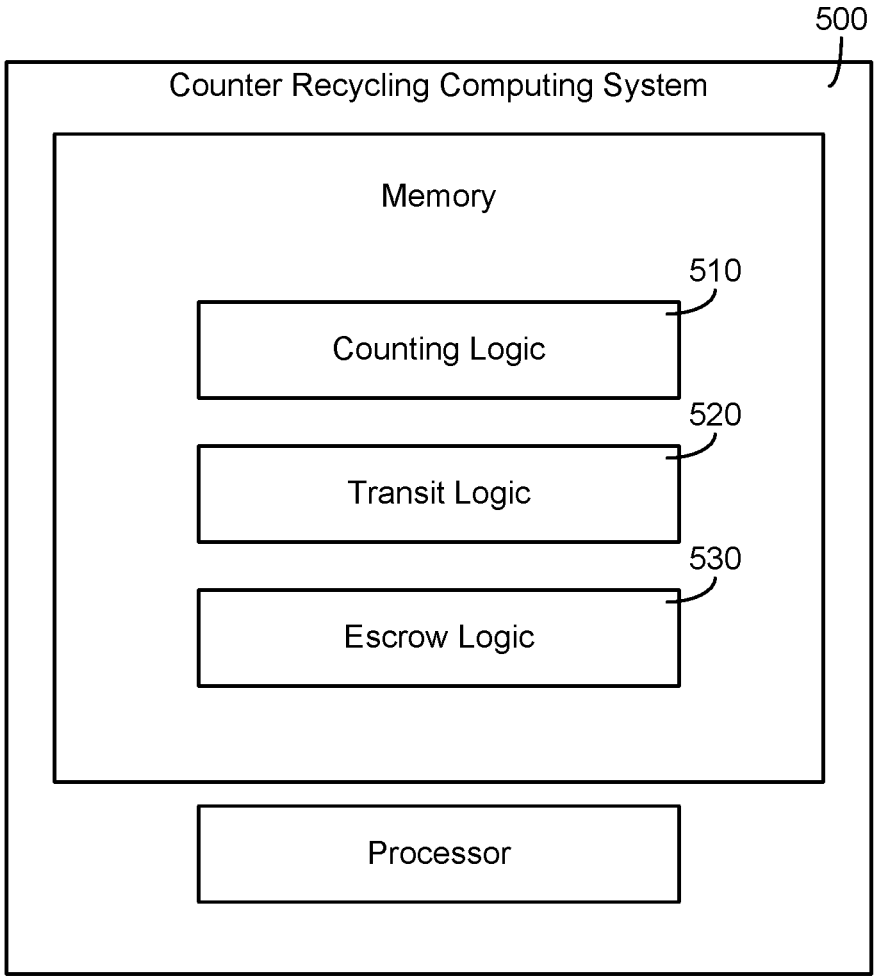
FIG. 5 is a schematic diagram of a counter recycling computing system according to an example embodiment.

FIG. 5 is a schematic diagram of a counter recycling computing system 500 according to an example embodiment. The counter recycling computing system 500 of the counter recycling device 100 may have logic disposed within memory and executable by a processor to implement the methods and functions discussed throughout the disclosure. The counter recycling computing system 500 may be configured to communicate with a financial institution computing system and/or update customer records regarding deposits. According to one example embodiment, the counter recycling computing system 500 contains counting logic 510, transit logic 520, and escrow logic 530. The counting logic 510 may communicate with a counter mechanism 225 within the counter recycling device 100 to count the currency received into the counter recycling device 100. In some embodiments, the counting logic 510 may be executed to show the amount of funds counted on a display, for example, viewable by a customer 110 or an operator 120 of the counter recycling device 100.

The transit logic 520 of the counter recycling computing system 500 facilitates the transfer and flow of currency throughout the counter recycling device 100 including the transit mechanism. The transit logic 520 may communicate with different parts of the counter recycling device 100 to transmit currency according to the methods and manners described herein. For example, transit logic 520 contains code executable by a processor to receive the currency in the receiving pocket 210, transfer the currency from the receiving pocket 210 to the counter mechanism 225 and from the counter mechanism 225 to the escrow section 230. The transit logic 520 may also be configured to transfer or prevent the transfer of currency from the escrow section 230 to the deposit area 250 upon determining, for example, that a set of conditions have been met.

The escrow logic 530 disposed within the counter recycling computing system 500 manages activity relating to the escrow section 230. For example, when funds are deposited into the escrow section 230, the escrow logic 530 may be configured to communicate with the transit logic 520 to facilitate a transfer of the funds from the escrow section 230 to the deposit area 250. The escrow logic 530 may also communicate with a user interface 220 to register and report activity related to the escrow door 240. For example, the escrow logic 530 may indicate when the escrow door 240 has been opened or confirm that the escrow door 240 has remained closed during the currency intake process. In one example, sensors may be used with the counter recycling computing system 500 and various logic disposed within the counter recycling computing system 500 to carry out the methods and functionalities as described throughout.

Figure 6:
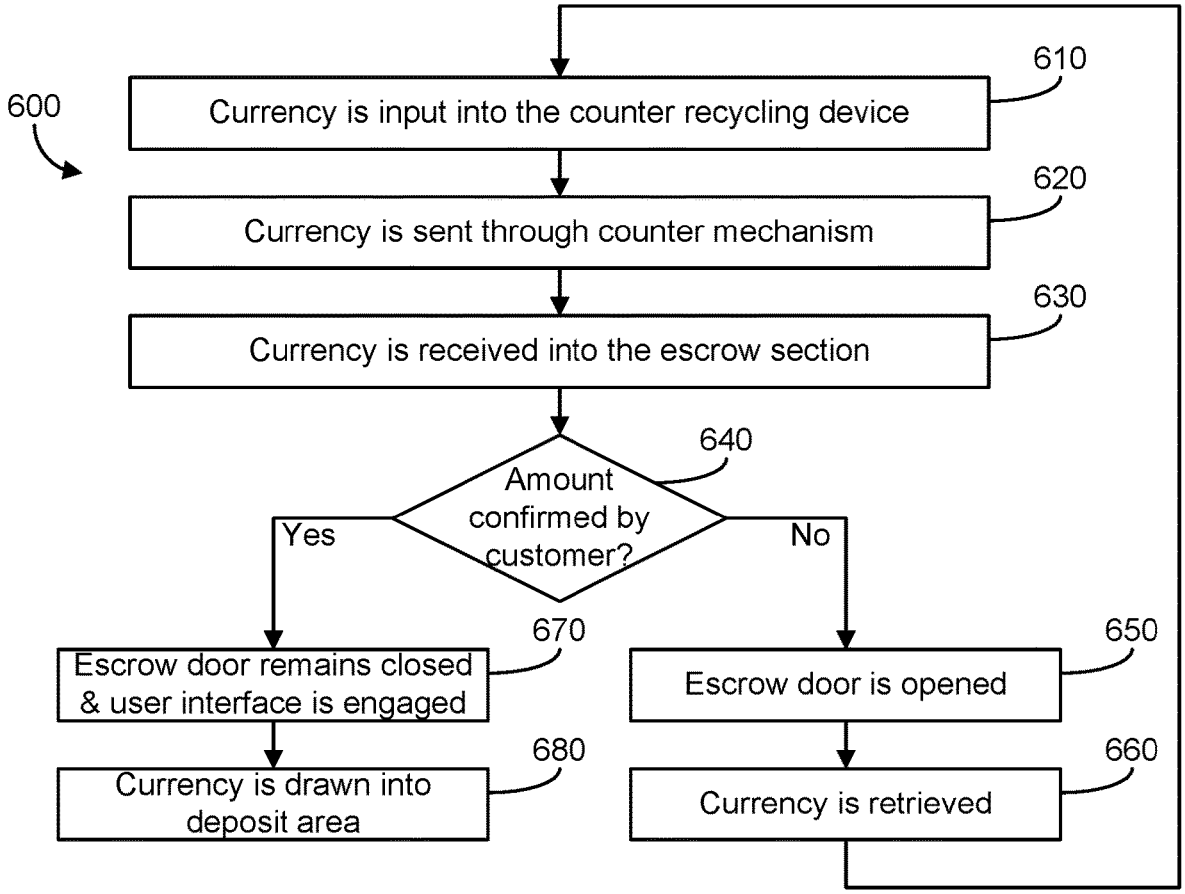
FIG. 6 is a flow diagram of a currency flow process through the counter recycling device according to an embodiment.

FIG. 6 is a flow diagram of a currency flow process 600 through the counter recycling device 100 according to an embodiment. At step 610, the currency is input into the counter recycling device 100 by a user such as an operator 120 (e.g, bank teller). In some embodiments, the counter recycling device 100 may be configured such that a customer 110 opposite the operator 120, as seen in FIG. 1, may be able to insert the currency into the receiving pocket 210. The receiving pocket 210 is configured to intake currency into the counter recycling device 100. As discussed above, the currency may go through conditioning processes while inside the counter recycling device 100. At step 620, the currency is sent through the counter mechanism 225, which counts the currency to determine the amount of currency deposited into the receiving pocket 210.

At step 630, the currency is received into the escrow section 230. The escrow section 230 may receive the currency from the currency transit mechanism. In some embodiments, the currency transit mechanism, or a portion thereof, may extend into the escrow section 230, which may be a box, a slot, or any configuration capable of securely holding currency within the counter recycling device 100. Once the currency is received into the escrow section 230, the currency flow may result in the currency being deposited into the deposit area 250 or the currency being removed based upon a confirmation by the customer 110 at step 640. At step 640, the amount of currency counted by the counter mechanism 225 may be confirmed by a customer 110. For example, a customer 110 as in FIG. 1 may pass an amount of currency to the operator 120 (i.e., teller). The operator 120 may insert the currency into the receiving pocket 210 of the counter recycling device 100, and the counter mechanism 225 may count the currency, which subsequently is transferred to the escrow section 230. The user interface 220 may relay that the counter mechanism 225 counted a total of $100 dollars, and the operator 120 may ask the customer 110 to confirm the accuracy of the amount. In one example, the customer 110 may disagree with the amount and claim that more or less currency was given to the operator 120. In this example, the operator 120 may open the escrow door 240 at step 650 and retrieve the currency from the escrow section 230 at step 560. In some embodiments, the counter recycling device 100 may be configured such that the currency is retrieved from the escrow tray 235 by the customer 110. In some embodiments, the operator 120 engages a user interface 220 to open the escrow door 240. The counter recycling device 100 or the counter recycling computing system 500 is configured to supply an indication that the escrow door 240 is opened, such as a noise, a click, a light, a beep, etc. This indication helps the customer 110 feel assured that the amount the customer 110 handed the operator 120 to input into the receiving pocket 210 is the same amount the customer 110 is receiving from the escrow section 230. In some embodiments, the customer 110 is assured that the same physical bill the customer 110 handed the operator 120 is the same physical bill the customer 110 receives from the escrow section 230. The transparency of the escrow door 240 and the viewing mechanisms discussed above, for example, also serve to reassure the customer 110 and gain the customer's confidence.

If a customer positively affirms the amount of currency counted at step 640, then the currency may be deposited into the deposit area 250. At step 570, the escrow door remains closed and the user interface 220 is engaged to initiate the intake of the currency from the escrow section 230 into the deposit area 250. The user interface 220 may include a button, for example, configured to be pushed to initiate the transfer of the currency from the escrow section 230 to the deposit area 250. In some embodiments, the currency may only be deposited into the deposit area 250 by the counter recycling device 100 when the escrow door 240 remains closed the entire process. According to other embodiments, the counter recycling device 100 and/or the counter recycling computing system 500 may also provide an indication when the currency is deposited into the deposit area 250 (i.e., the deposit may show up on a display on the counter recycling device 100 or on a financial institution computer system display screen. At step 680, the transit mechanism may respond to the engagement of the user interface 220 and draw the currency from the escrow section 230 into the deposit area 250.

It should be noted that although the diagrams herein may show a specific order and composition of method steps, it is understood that the order of these steps may differ from what is depicted. For example, two or more steps may be performed concurrently or with partial concurrence. Also, some method steps that are performed as discrete steps may be combined, steps being performed as a combined step may be separated into discrete steps, the sequence of certain processes may be reversed or otherwise varied, and the nature or number of discrete processes may be altered or varied. The order or sequence of any element or apparatus may be varied or substituted according to alternative embodiments. Accordingly, all such modifications are intended to be included within the scope of the present disclosure. Such variations will depend on the software and hardware systems chosen and on designer choice. It is understood that all such variations are within the scope of the disclosure. Likewise, software and web implementations and components of the present disclosure could be accomplished with standard programming techniques with rule based logic and other logic to accomplish the various database searching steps, correlation steps, comparison steps and decision steps.

The foregoing description of embodiments of the disclosure has been presented for purposes of illustration and description. It is not intended to be exhaustive or to limit the disclosure to the precise form disclosed, and modifications and variations are possible in light of the above teachings or may be acquired from practice of the disclosure. The embodiments were chosen and described in order to explain the principals of the disclosure and its practical application to enable one skilled in the art to utilize the disclosure in various embodiments and with various modifications as are suited to the particular use contemplated. Other substitutions, modifications, changes and omissions may be made in the disclosure's operating conditions and arrangement of the embodiments without departing from the scope of the present disclosure.

What is claimed is:

1. A device comprising:

a receiving pocket configured to accept a quantity of currency into an escrow section;

a transit mechanism configured to transport the quantity of currency between the escrow section and a deposit area in the device, wherein the escrow section is configured to hold the quantity of currency;

a counter mechanism connected to the receiving pocket, the counter mechanism configured to count the currency;

an escrow door movable between a closed position and an open position, wherein in the closed position the escrow door is configured to enclose the escrow section on a face of the device, and wherein in the open position the currency in the escrow section is retrievable from an outside of the device;

an escrow tray movable between a first position and a second position, the first position substantially within the escrow section and the second position extending least partially outside of the escrow section;

a processor; and computer memory storing circuitry that, when executed by the processor, is structured to perform operations comprising:

determine whether the escrow door is in the closed position when the quantity of currency enters the escrow section;

provide a first indication that the escrow door is in the closed position when the quantity of currency enters the escrow section;

determine whether the escrow door remains in the closed position throughout a transit of the quantity of currency from the receiving pocket to the escrow section;

provide a second indication that the escrow door remains in the closed position throughout the transit of the quantity of currency from the receiving pocket to the escrow section;

cause, based on receiving the first indication and the second indication, the transit mechanism to transfer the quantity of currency from the escrow section to the deposit area;

cause, based on receiving one or fewer of the first indication and the second indication, the transit mechanism to automatically prevent the transfer of the quantity of currency from the escrow section to the deposit area.

2. The device of claim 1, wherein the escrow section is downstream of the counter mechanism.

3. The device claim 1, wherein the escrow door comprises a plastic or glass see-through material.

4. The device of claim 1, further comprising user interface configured to be engaged by an operating user.

5. An apparatus comprising:

a receiving pocket configured to accept currency;

a counter mechanism connected to the receiving pocket to receive the currency, the counter mechanism configured to count the currency inserted into the receiving pocket;

an escrow section, wherein the escrow section is configured to collect and hold the currency counted by the counter mechanism in a secure area;

an escrow door movable between an open position and a closed position, wherein in the closed position the escrow door is configured to enclose the escrow section;

an escrow tray movable between a first position and a second position, the first position substantially within the escrow section and the second position extending least partially outside of the escrow section, through the escrow door when the escrow door is in the open position;

a deposit area, wherein the deposit area is configured to receive the currency from the escrow door;

a transit mechanism within the apparatus configured to transfer the currency throughout the apparatus;

a user interface configured to provide a notification that indicates when the escrow door is opened or closed;

a processor; and computer memory storing transit logic and escrow logic, wherein:

the escrow section is positioned in a currency flow direction between the receiving pocket and the deposit area, the escrow logic is configured such that, when the processor executes the escrow logic, the processor is caused to determine information about the escrow door including whether the escrow door is in the open position or the closed position, and the transit logic is configured such that, when the processor executes the transit logic, the processor is caused to:

retrieve the information about the escrow door, determine, based on the information about the escrow door, (i) whether the escrow door is in the closed position when the currency enters the escrow section, and (ii) whether the escrow door remains in the closed position throughout a transfer of the currency from the escrow section to the deposit area;

the apparatus is configured to receive a transfer initiation to initiate a transfer of the currency from the escrow section to the deposit area, responsive to the transit logic determining that the escrow door is in the closed position when the currency enters the escrow section and that the escrow door remains in the closed position throughout the transfer of the currency from the escrow section to the deposit area; and the apparatus is configured to receive a withdrawal initiation to facilitate movement of the escrow door to the open position and allow currency to be retrieved from the escrow section, the apparatus being configured to open the escrow door and automatically prevent the currency in the escrow section from being transferred to the deposit area upon receiving the withdrawal initiation.

6. The apparatus of claim 5, wherein the user interface is communicatively coupled to the apparatus, the user interface configured to be engaged to communicate the transfer initiation or the withdrawal initiation to the apparatus.

7. The apparatus of claim 5, wherein the escrow door is configured to allow the currency within the escrow section to be at least partially viewable to a customer when the escrow door is in the closed position.

8. The apparatus of claim 7, wherein the escrow door is transparent.

9. A method for counting and recycling currency comprising:

accepting currency into a receiving pocket on an exterior of a counter recycling device;

transferring the currency to a currency counter in the counter recycling device;

counting the currency input into the receiving pocket using the currency counter;

receiving the currency as counted into an escrow section positioned within the counter recycling device, the counter recycling device comprising a transit mechanism, a processor and computer memory that stores escrow logic and transit logic;

receiving an initiation to transfer the currency from the escrow section to a deposit area within the counter recycling device between the receiving pocket and a deposit area in a currency flow direction;

providing an escrow door attached to the escrow section, the escrow door movable from a closed position to an open position to provide selective access to the escrow section;

determining, by the processor using the escrow logic, information about the escrow door including when the escrow door has been opened or closed;

determining, by the processor using the transit logic and based on the information about the escrow door, (i) that the escrow door is in the closed position when the currency enters the escrow section and (ii) that the escrow door remains in the closed position throughout a transit of the currency from the escrow section to the deposit area;

responsive to determining that (i) and/or (ii) are not met, automatically cause, by the processor using the transit logic:

the transit mechanism to prevent the transfer of the currency from the escrow section to a deposit area in the counter recycling device; and an escrow tray to move from a first position to a second position, the first position substantially within the escrow section and the second position extending least partially outside of the escrow section, through the escrow door when the escrow door is in the open position;

responsive to the determining (i) and (ii) are met causing, by the processor using the transit logic, the transit mechanism to transfer the currency from the escrow section to the deposit area in the counter recycling device; and transmitting a notification to a user interface that indicates when the escrow door is opened or closed.

10. The method of claim 9, wherein the escrow section is configured to allow the currency to be viewable through the escrow door in the closed position.

11. The method of claim 9, further comprising:

receiving an initiation to open the escrow section;

opening the escrow door of the escrow section; and preventing currency from entering the deposit area from the escrow section once the escrow door is opened.

12. The method of claim 11, further comprising transmitting a notification once the escrow door is in the open position, the notification comprising at least one of a click, an audible sound emitted electronically, and a light that indicates when the escrow door is in an open position or a closed position.

13. The method of claim 9, wherein the transit mechanism is a currency transit mechanism used to transfer the currency from the escrow section to the deposit area.

14. A method for completing teller transactions comprising:

accepting, using a receiving pocket, currency into a counter recycling device, the counter recycling device comprising a transit mechanism, a processor and computer memory that stores escrow logic and transit logic;

transferring, using the transit mechanism, the currency to a currency counter in the counter recycling device;

counting the currency accepted into the receiving pocket using the currency counter;

receiving the currency as counted into an escrow section positioned within the counter recycling device between the receiving pocket and a deposit area, the escrow section being transparent and configured to allow the currency to be viewable through an escrow door attached to the escrow section and movable between an open position and a closed position;

initiating a transfer of the currency from the escrow section within the counter recycling device to a deposit area;

determining, by the processor using the escrow logic, information about the escrow door including when the escrow door has been opened or closed;

determining, by the processor using the transit logic and based on the information about the escrow door, (i) whether the escrow door is in the closed position when the currency enters the escrow section and (ii) whether the escrow door remains in the closed position throughout a transit of the currency from the escrow section to the deposit area;

automatically cause, by the processor using the transit logic and responsive to determining that (i) and/or (ii) is not met:

the transit mechanism to prevent the transfer of the currency to the deposit area; and an escrow tray to move from a first position to a second position, the first position substantially within the escrow section and the second position extending least partially outside of the escrow section, through the escrow door when the escrow door is in the open position;

automatically cause, by the processor using the transit logic and responsive to determining that (i) and (ii) are met, the transit mechanism to automatically transport the currency to the deposit area; and transmitting a notification to a user interface that indicates when the escrow door is opened or closed.

15. The method of claim 14, further comprising receiving a confirmation from a customer that the counted currency is accurate prior to transferring the currency from the escrow section to the deposit area.

16. The method of claim 14, further comprising opening the escrow door, wherein the currency is removed from the escrow section and re-inserted into the receiving pocket and counted in order to be transferred from the escrow section to the deposit area.

17. The method of claim 14, wherein the user interface is used to initiate the transfer of the currency from the escrow section to the deposit area, the user interface comprising one or more of a display, a touch screen display, a smart touchpad, and a keypad.

18. The device of claim 1, further comprising a currency conditioner configured to selectively perform a conditioning operation on the currency.

19. The device of claim 18, wherein the currency conditioner comprises:

one or more sensors configured to detect characteristics of the received currency; and a heating element configured to heat the currency.

20. The device of claim 19, wherein the conditioning operation comprises:

determining, by the processor, a condition of the currency;

heating, by the heating element, the currency responsive to determining that the condition of the currency is not suitable for recycling; and selectively exerting pressure, by the transit mechanism, responsive to determining that the condition of the currency is not suitable for recycling.

21. The device of claim 1, wherein the transit mechanism is structured to operate the escrow tray from the first position to the second position when the escrow door is in the open position.

22. The device of claim 1, wherein the escrow tray is coupled to a surface of the escrow section.

23. The device of claim 1, wherein the escrow tray is structured to receive the quantity of currency.

* * * * *